US005755238A

United States Patent [19]

Soots et al.

[11] Patent Number: 5,755,238

[45] Date of Patent: May 26, 1998

[54] METHOD AND APPARATUS FOR LOW RESIDENCE TIME REDRYING OF TOBACCO

[75] Inventors: Carlton Andrew Soots, Gainesville, Fla.; Anthony J. Riviere, Columbia, S.C.; Kevin R. Korte, Sr., Macon, Ga.

[73] Assignee: Brown & Williamson Tobacco Corporation, Louisville, Ky.

[21] Appl. No.: 732,928

[22] Filed: Oct. 17, 1996

[51] Int. Cl.[6] ..... A24B 3/12

[52] U.S. Cl. ..... 131/302; 131/303; 131/304; 131/290; 131/291

[58] Field of Search ..... 131/300, 302, 131/303, 304, 903, 290, 291

[56] References Cited

U.S. PATENT DOCUMENTS

| | | | |
|---|---|---|---|
| 2,882,910 | 4/1959 | Jones et al. | 131/302 |
| 3,060,590 | 10/1962 | Brown | 131/302 |
| 3,224,452 | 12/1965 | Franklin et al. | 131/302 |
| 3,402,479 | 9/1968 | Hohm et al. | 131/302 |
| 3,502,085 | 3/1970 | Wochnowski | 132/302 |
| 3,948,277 | 4/1976 | Wochnowski et al. | 131/303 |
| 4,091,824 | 5/1978 | Psaras | 131/135 |
| 4,252,133 | 2/1981 | Buske et al. | 131/303 |
| 4,346,524 | 8/1982 | Wochnowski et al. | 34/26 |
| 4,434,563 | 3/1984 | Graalmann et al. | 131/303 |
| 4,499,943 | 2/1985 | Schafer | 131/303 |
| 4,572,218 | 2/1986 | Hine et al. | 131/303 |
| 4,583,559 | 4/1986 | Hedge | 131/303 |
| 4,646,760 | 3/1987 | Egri | 131/303 |
| 4,932,424 | 6/1990 | Liebe et al. | 131/303 |
| 4,944,316 | 7/1990 | Stahle et al. | 131/303 |
| 4,945,930 | 8/1990 | Neville | 131/303 |
| 5,103,842 | 4/1992 | Strange et al. | 131/303 |
| 5,383,479 | 1/1995 | Winsterson et al. | 131/303 |

FOREIGN PATENT DOCUMENTS

| | | | |
|---|---|---|---|
| 2368229A | 5/1978 | France | 131/302 |
| 2402538A | 7/1975 | Germany | 131/302 |
| 2203929 | 11/1988 | United Kingdom | 131/302 |

*Primary Examiner*—Vincent Millin
*Assistant Examiner*—Charles W. Anderson
*Attorney, Agent, or Firm*—Charles T. Sherman; Middleton & Reutlinger; John F. Salazar

[57] ABSTRACT

A method and apparatus is given for a low residence time redrying of strip tobacco. The apparatus thoroughly and evenly dries and cools the tobacco consistently through the entire tobacco bed as it passes through the dryer and cooler. The apparatus utilizes a plurality of individually controlled fluidized bed heating zones for drying the tobacco. An additional fluidized bed cooling zone is provided to cool the tobacco prior to reordering. A continuous conveyor extends through the heating zones and cooling zones. A steam tunnel is utilized to raise the moisture content of the dried tobacco to preselected moisture levels. A vibrating conveyor moves the tobacco through the steam tunnel.

16 Claims, 5 Drawing Sheets

METHOD AND APPARATUS FOR LOW RESIDENCE TIME REDRYING OF TOBACCO

BACKGROUND OF THE INVENTION

1. Field of the Invention

This invention relates to processing of strip tobacco, and more specifically with the rapid drying, cooling and reordering of strip tobacco in a tobacco processing plant.

2. Discussion of the Prior Art

Redrying of tobacco leaf material is common in processing of tobacco material, particularly burley tobacco, prior to use in cigarettes and after application of a heavy casing material. In the redrying of tobacco leaf material control of the moisture content of the tobacco is a goal pursued due to the stringent requirements of specific moisture contents of the tobacco leaf needed for further processing. Processing of the tobacco material including drying is preferably done at high speeds in order to keep processing costs down and keep the space required for processing in the manufacturing plant to a minimum and each step of the processing of tobacco leaf material requires the tobacco to be kept at a constant moisture content. Additionally, time, temperatures, and humidity for drying tobacco material affects the chemical composition and flavor of the processed tobacco. Prior to drying, strip tobacco typically has a moisture content of around 30%. After drying the moisture content may be as low as 5% and the tobacco is left very brittle which may cause breakage of the tobacco leaf during further processing. The breakage is especially pronounced as the tobacco leaf, after drying, is at around 5% moisture content. And, so that the chemical composition of the leaf and subjective flavor remain optimal, the moisture content after drying must be closely controlled to the ideal content of about 5%. This close control of moisture content must be accomplished with as minimal breakage and fluctuation of the moisture content and chemical composition as possible. This breakage, or degradation of the tobacco leaf, is remedied by the addition of moisture to the leaf material in a reordering step. Remoistening of the tobacco leaf, or reordering, raises the moisture content of the leaf material to around 15% so that the tobacco leaf may be further processed without further degradation and to keep the tobacco material at the optimal moisture content for further processing. Reordering is typically accomplished utilizing water, steam or a combination of both in combination with tumbling of the tobacco in a rotating cylinder. This however often results in additional damage to the tobacco product. As such, the process and apparatus for drying, cooling and reordering the tobacco material is very important.

Typically, drying of strip tobacco is accomplished using an apron dryer. In an apron dryer, air is blown from underneath the conveying means upon which the tobacco is placed, with the drying air being exhausted from above the tobacco product. Alternatively, some dryers may include drying zones which have air being blown from the top of the drying zone through the tobacco material and conveying apparatus and exhausted through the bottom of the dryer. Diffuser plates are generally used in the conveying means to even out airflow across the apron conveyor in the updraft zones. Dryers of this type have inherently high moisture variation and therefore the tobacco processed therein is susceptible to varying tastes and quality.

In addition, the speed at which drying and reordering of the tobacco is done directly affects the overall costs and chemical composition of the tobacco processed. Typically, drying, cooling and reordering of tobacco prior to utilization in a cigarette manufacturing process takes in the range of 20 to 40 minutes. The time required for conditioning of the material is long because, in drying, the tobacco is treated by passing the tobacco through a tortuous air flow path, tumbling the tobacco through an airstream, or the tobacco is passed over jets of air. Passing the tobacco through a tortuous air flow path causes hygienic problems, clogging problems as well as other airflow path problems which must frequently be solved. Passing the tobacco over air jets also causes great variations in drying of the tobacco bed. Such inconsistencies create processing problems down the manufacturing line in that some of the sections of tobacco have been kept at appropriate temperatures while other sections have not. Additionally, the chemical composition of the tobacco may differ as it has been dried to differing moisture contents. Thus, a large amount of time is needed in order to properly and evenly dry the tobacco material.

Additional problems are also associated with reordering of the tobacco. If the moisture applied to the tobacco is only applied at specific points, certain areas of the tobacco bed will have a higher moisture content than others which changes the characteristics of the tobacco. It is therefore required to have drying and reordering of the tobacco without a great differential in two different samples as well as keeping the processing time at a minimum.

In particular, drying of the tobacco material directly effects the generation of pyrazines in the tobacco. Attempts at changing the drying process with regards to speed and drying temperature can affect the level of pyrazines in the tobacco thereby affecting substantive aspects of the processed material such as flavor and aroma. Any change in the drying process therefore must not change the composition of the tobacco as it relates to pyrazines and other constituent elements.

SUMMARY OF THE INVENTION

The present invention provides a method for low residence time redrying, cooling and reordering of strip tobacco material with minimal degradation of the tobacco during processing. The present invention causes evenly distributed drying and moistening across the entire bed of tobacco material processed as well as only requiring a limited amount of time to fully complete the drying, cooling and reordering of the tobacco. The present invention additionally provides a means for rapid drying and reordering of tobacco in large quantities which are processed in a short amount of time and in very little floor space while also keeping the handling damage of the tobacco to a minimum.

The method of the present invention is comprised of low residence time drying using fluidized bed technology while requiring very little processing time, total residence time being about 10% of the drying time required in prior art redrying techniques. For redrying of the tobacco material, a bed of tobacco is formed on a belt conveyor. The tobacco bed passes through five drying zones, each zone drying the tobacco using heated air blown from above the tobacco through a pressure plenum. In each drying zone, heated air is directed towards the upper surface of the tobacco while also preventing small fragments of the tobacco from recirculating through the dryer. The tobacco is then conveyed to a cooler where the heated tobacco is cooled with ambient air being directed downwardly onto the tobacco material which is then conveyed to a reorderer which remoistures the tobacco to an appropriate moisture content.

The method of the present invention more particularly comprises passing strip tobacco from a bulker onto a belt conveyor at a predetermined bed depth. The tobacco passes through a dryer where heated air is blown onto the tobacco at between 220° F. to 240° F. The tobacco is dried to about 5% moisture content. The tobacco is then cooled utilizing ambient air to about 80° F. The tobacco, using vibrational conveying on an upward slope, is reordered through a steam tunnel. At the exit of the steam tunnel (reorderer), the tobacco exhibits a moisture content of about 15% which is the moisture content required for utilization in filling cigarettes. The entire time the tobacco is resident in processing is only about two minutes.

Finally, the present invention comprises a drying tobacco in a plurality of fluidized bed dryers using heated air; cooling said tobacco in a fluidized bed cooler using ambient air; and, reordering said tobacco in a steam tunnel in order to raise the moisture content of said tobacco.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
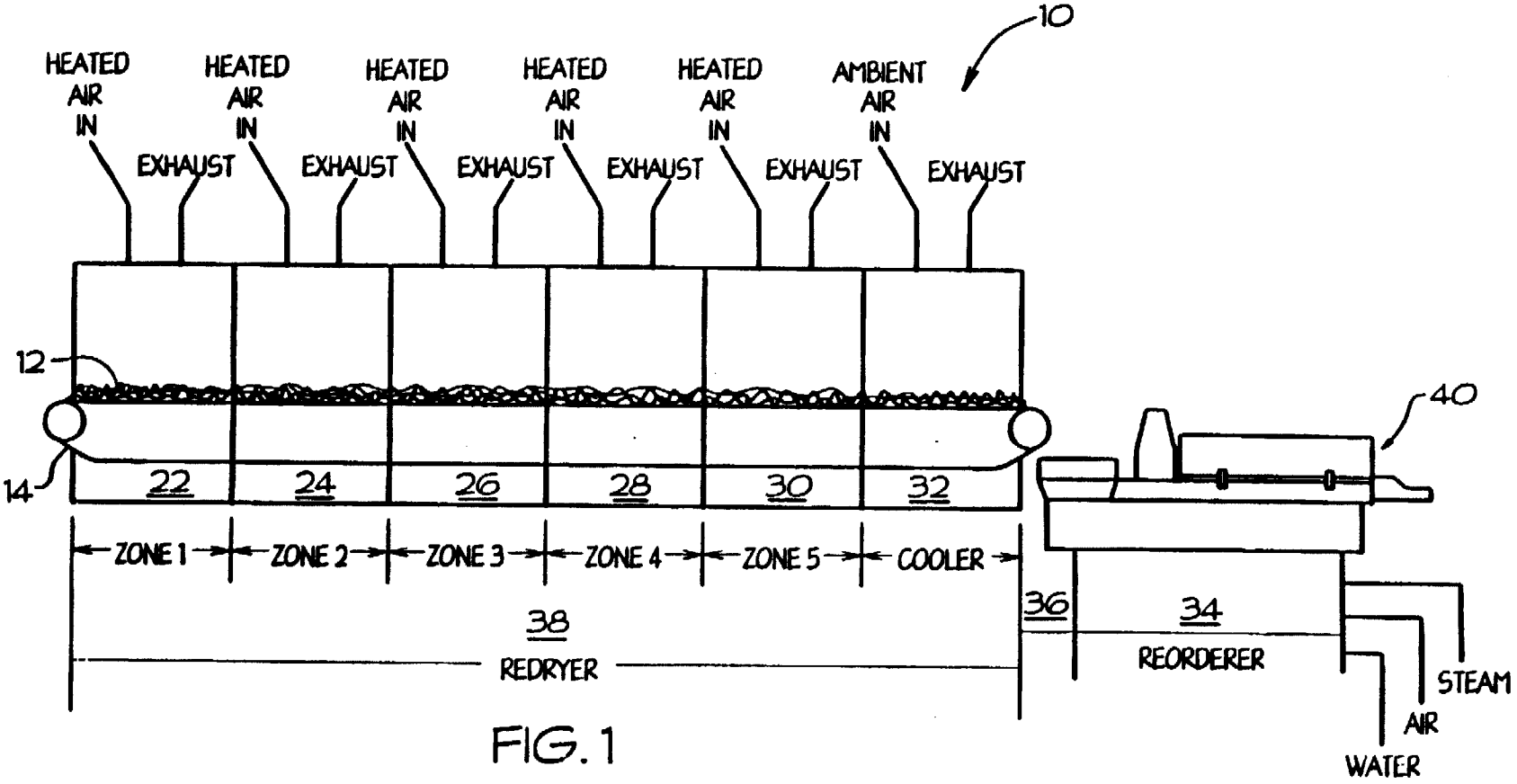
FIG. 1 is an exemplary view of the processing apparatus for drying, cooling and reordering the tobacco.

In a preferred embodiment of an apparatus 10 of the present invention for low residence time drying, cooling and reordering of strip tobacco is shown schematically in FIG. 1. Strip tobacco 12 is fed from a bulker, not shown, onto a continuous conveyor belt 14. The tobacco 12 is placed onto belt 14 at a constant depth of about 3 inches along the entire cross-section of belt 14. Belt 14 passes the tobacco through each of the drying/heating zones of the dryer 38, said zones being identified as Zone 1, Zone 2, Zone 3, Zone 4 and Zone 5, respectfully referenced as 22, 24, 26, 28 and 30. The dryer 38 is comprised of separate independently controlled heating zones so that the tobacco may be accurately processed and the drying may be finely controlled. Each zone can be controlled independently, said controls including temperature, plenum pressure, and exhaust air flow. Each zone of the drying process dries the tobacco 12 using known fluid bed technology, one such dryer being a Jetzone Fluid Bed unit manufactured by Wolverine Corporation. Each of the zones 22, 24, 26, 28 and 30 is independently controlled and has an independent heated air intake and exhaust, as shown in FIG. 1. After drying, tobacco 12 is then passed into a cooler 32 which again utilizes fluid bed technology, such as the previously described Jetzone Fluid Bed unit, except without utilizing heated air at the intake. The tobacco 12 is cooled using ambient air to reduce the temperature of the tobacco 12 for proper reordering. From cooler 32 the tobacco 12 passes from continuous belt 14 to a steam/water bed 36 which accepts the evenly distributed dried and cooled tobacco 12 with minimal handling damage. Steam/water bed 36 provides a cushioned drop area created by steam/water bed 36 where tobacco 12 falls before beginning the process through reorderer 34. In the reorderer 34 the bed of dried tobacco 12 is subjected to steam in order to raise the moisture content of the tobacco 12 to an appropriate level of about 15% moisture. Using vibrational conveyance at a slightly upward angle of inclination tobacco 12 passes through steam tunnel 40 of the reorderer 34. This allows the dried and remoistened tobacco 12 to pass through the reorderer 34 with no mechanical handling which would promote damage to the dried tobacco material 12.

Dryer 38, as stated previously, is comprised of five independent drying zones, 22, 24, 26, 28 and 30 through which continuous belt conveyor 14 passes. Belt conveyor 14 conveys tobacco 12 at about a three inch depth and is 7 feet wide. The conveyor 14 is a single conveyor which passes through each of the drying zones as well as the cooling zone in order to minimize handling damage.

Figure 2:
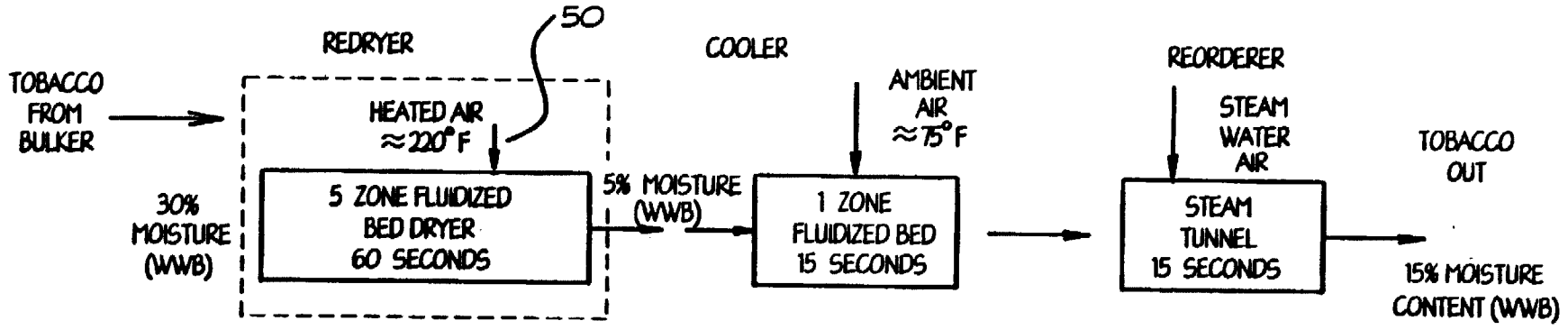
FIG. 2 is a block diagram illustrating the processing required for low residence time drying, cooling and reordering.

Tobacco 12 enters dryer 38 from a bulker at around 30% moisture content, as shown in FIG. 2. Heated air 50 is forced into each dryer zone into a pressure plenum 52, shown in FIG. 3, at the following pressures and temperatures:

| ZONE | AIR TEMPERATURE | PLENUM PRESSURE |
|---|---|---|
| HEATING ZONE 1 | 220° F. | 2.5 inches water |
| HEATING ZONE 2 | 240° F. | 2.0 inches water |
| HEATING ZONE 3 | 240° F. | 1.5 inch water |
| HEATING ZONE 4 | 240° F. | 1.0 inch water |
| HEATING ZONE 5 | 240° F. | 0.5 inch water |
| COOLING ZONE 1 | 75° F. | 0.5 inch water |

Heated air 50 is then forced through a plurality of jet tubes 54 and impinges upon tobacco 12 at a velocity of between 1000 to 3000 feet per minute. Jet tubes 54, in flow communication with said pressure plenum 52, are hollow and about 12 inches long. The temperature of heated air 50 in the pressure plenum 52 of zone 1 dryer 22 is at about 22020 F. As stated, each zone of dryer 38 is independently controlled having its own heated air intake and exhaust, as shown in FIG. 1.

Continuous belt 14 conveys the tobacco product 12 through the entire dryer 38 at about 1.3 ft/sec. Drying zones 2, 3, 4 and 5, represented by reference numerals 24, 26, 28 and 30, utilize an air temperature of about 240° F. and force the air 50 through pressure plenum 52 at the pressures specified above. The differing temperatures applied in each drying zone are used in order to minimize case hardening and leaf curling which may occur when drying of the tobacco leaf is attempted under high temperatures. Total residence time of the tobacco 12 in dryer 38 is only about 60 seconds. Dryer 38 is approximately 80 feet in length and, as previously stated, 7 feet wide. Tobacco 12, at the entry of dryer 38, is at about 30% moisture content. Upon exiting of drying 38, tobacco 12 has been evenly dried to about 5% moisture content in roughly 10 of the time it would take to dry the tobacco in a standard commercially available apron drier.

Figure 3:
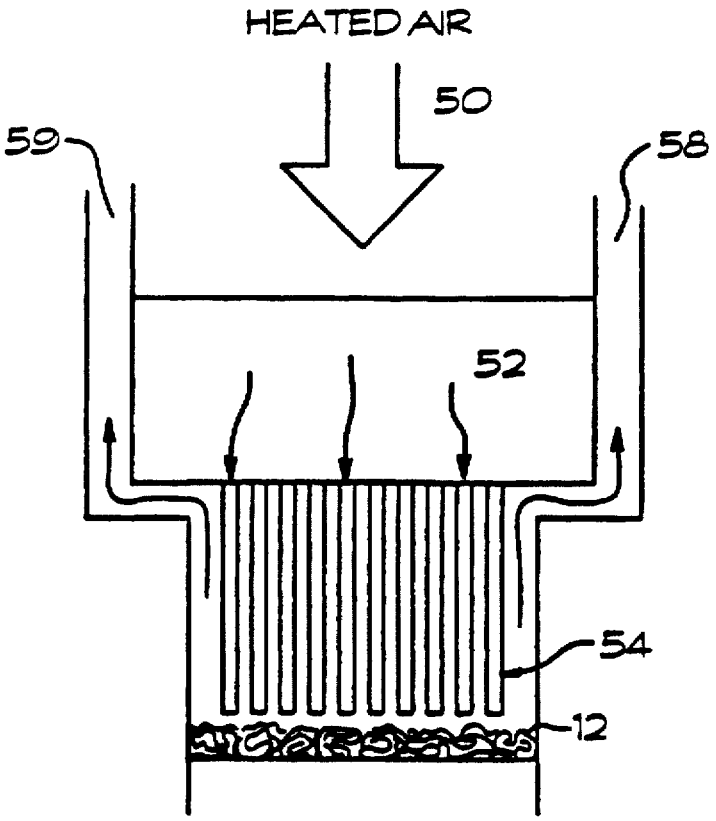
FIG. 3 is a front view of a fluidized bed which shows air directed onto processed tobacco.

As shown in FIG. 3, the dryer zones 22, 24, 26, 28 and 30 have a plurality of jet tubes 54 which are in flow communication with the pressure plenum 52. Jet tubes 54 force heated air downward onto the tobacco bed 12 with minimal disturbance of tobacco 12 yet causing an even drying of the tobacco throughout the tobacco bed and preventing deviation of moisture content throughout the bed depth. Accurate drying of the tobacco material is required because of pyrazine generation, removal of harsh volatiles and improved machinability of the leaf. Drying of the tobacco material must be closely monitored due to the drying of the heavy casing which is applied prior to this process, as improper drying may harden the casing and cause the tobacco leaf to curl.

As shown in FIG. 3, air 50 forced through jet tubes 54 is recirculated back up through each dryer zone 22, 24, 26, 28 and 30 as well as cooling zone 32 through return channels 58 and 59. In order to keep the dried tobacco material 12 from entering the exhaust return lines 58 and 59 of each of the dryers, balancing of the intake and exhaust fans is required for each zone. Heated air 50 is provided in the pressure plenum 52 through forced air from the plurality of jet pipes 54. Air 50 is forced against the moving bed of tobacco 12 at a high rate of speed. Air 50 returns up both side exhaust vents 58 and 59, shown in FIG. 3 for recirculation back through the independent dryer zone. The air is recirculated within the dryer or cooler zone creating a closed system which can be readily balanced by adjustment of intake and exhaust fans. Tobacco bed 12 requires very little residence time in dryer 38 in order to properly dry the material to the requisite level, typically in the order of around 60 seconds.

Figure 5:
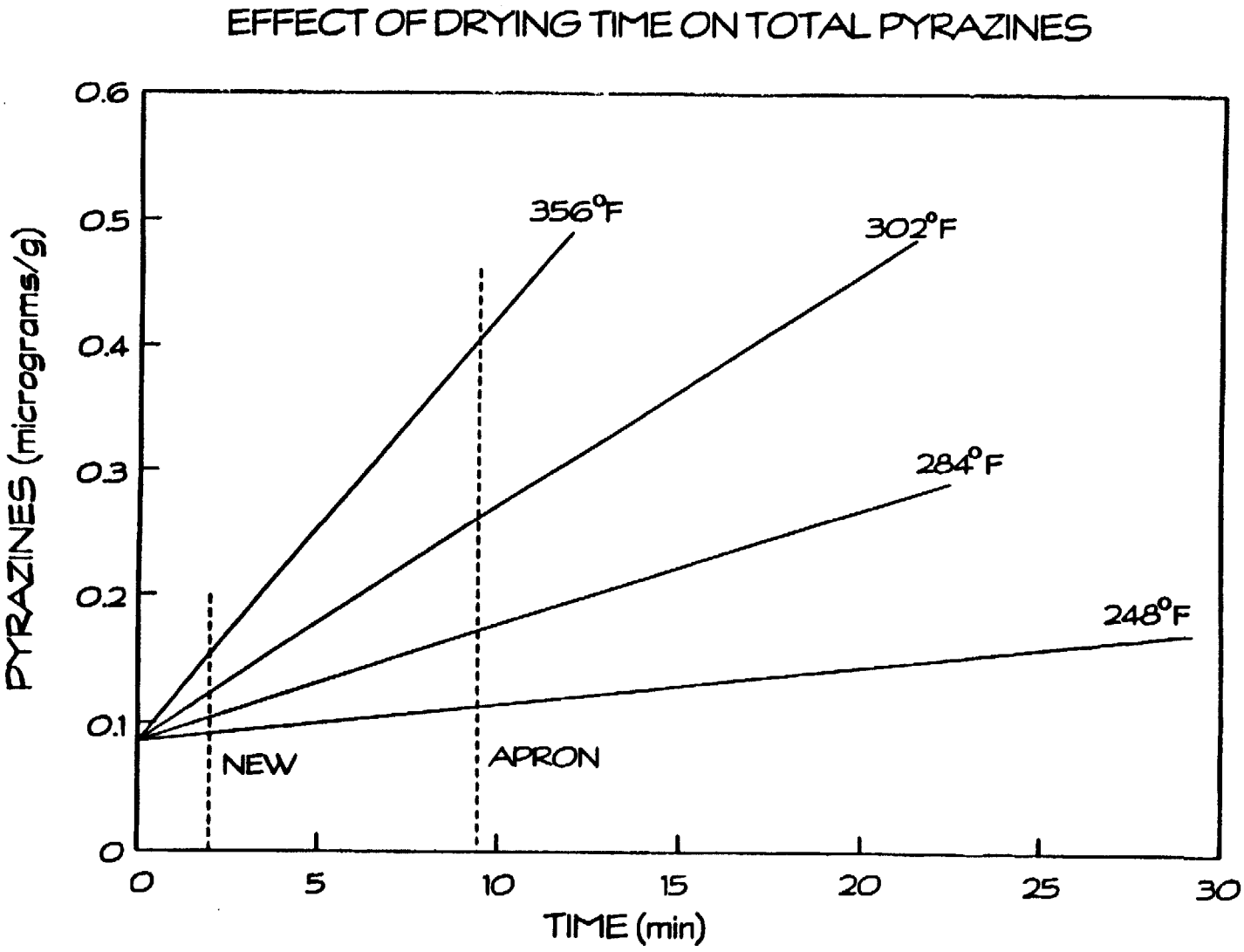
FIG. 5 is a graph representing the production of pyrazines in tobacco during drying.

As a result of the drying process, pyrazines are generated in the tobacco. The amount of pyrazines generated are directly related to the temperature at which the tobacco is dried as well as the total drying time. Pyrazine formation in the tobacco affects the flavor and substantive appeal of the smoked material. As a result, drying of the tobacco must be closely analyzed to ensure that the chemical composition of pyrazines in the tobacco remain constant from process to process. FIG. 5 shows a graph of pyrazine formation using different drying temperatures. Drying the tobacco 12 using dryer 38 with an air temperature of around 248° F. causes little or no differential in overall content of pyrazines. Alteration of total drying time also affects pyrazine formation and must additionally be controlled. With the method of the present invention, pyrazine formation remains fairly constant while drying at about 248° F. even though the drying time is reduced from more than minutes to 90 seconds. Thus, a reduction in total drying time utilizing a process and apparatus such as described herein may be accomplished while still achieving uniformity in redrying of the tobacco to about 5% moisture content.

After passing through dryer 38, the tobacco is at about 5% moisture content. Because the tobacco is at such a low moisture content, it is susceptible to damage and breaking so handling must be kept at a minimum. Also, prior to utilizing the tobacco 12 in cigarette production, it must be remoistened as the requisite moisture content of tobacco in the final cigarette product is about 15%. To accomplish this task, the tobacco 12 must pass through cooler 32 which uses the same jet tubes 54 as are shown in FIG. 3. The air 52 used in cooler 32, however, is at ambient temperature, approximately 75° F., cooling the tobacco in the tobacco bed 12 to around 80° F. Total residence time of tobacco 12 in cooler 32 is about 15 seconds and requires only about 20 feet of processing length to reduce the tobacco to the appropriate temperature.

Figure 4:
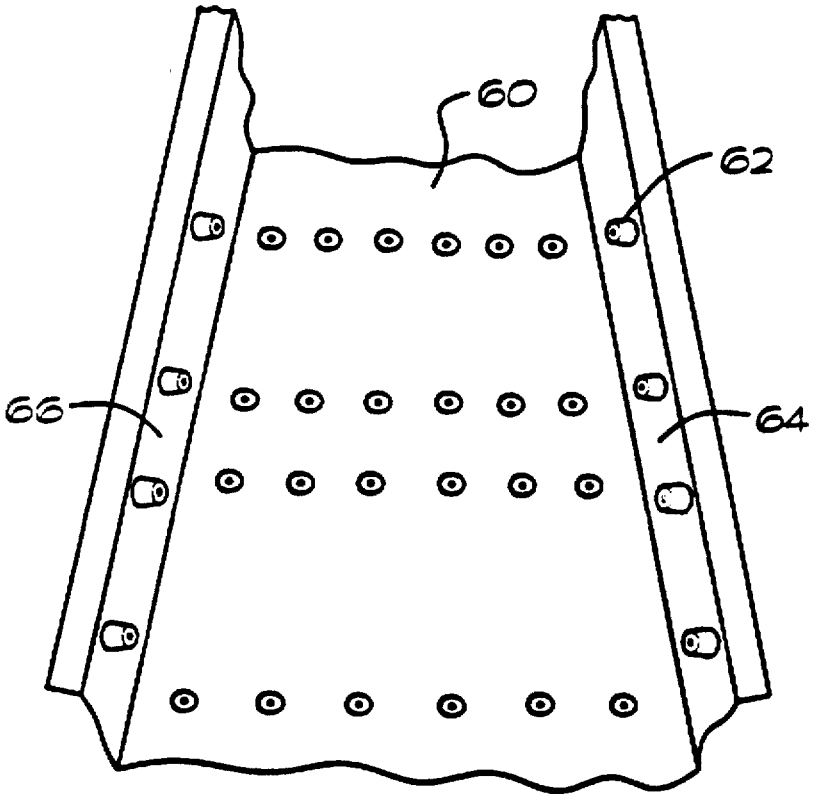
FIG. 4 is a perspective view of a reorderer.

The tobacco enters the reordering phase in order to raise the moisture content of the tobacco to the appropriate levels, from 5% moisture content to around 15% moisture content. In order for the tobacco to pass from conveyor 14 into steam tunnel 40 of reorderer 34, transitional steam bed 36 is provided. Transfer station 36 is a steam/water bed which receives the tobacco from conveyor into steam tunnel 40. The height differential between conveyor 14 and transition station 36 is about 42 inches. A blanket of steam or water is provided under an independent pressure source at the beginning of the reorderer 34 to cushion the fall of the tobacco material 12 and to provide an initial high density moisturizing zone while also insuring product degradation is kept to a minimum. This drop zone/steam blanket 34 is located at the infeed of the steam tunnel 40. The source of the steam or water, as previously stated, is under an independent header and can be controlled independently from the steam tunnel 40. The vibrational conveying system of the reorderer 34 takes over at this point and progresses the tobacco material 12 up a slight uphill gradient through steam tunnel 40. Steam tunnel 40, shown in FIG. 4, is comprised of bed 60, side walls 64 and 66, and a plurality of atomizers 62 which are formed in the bed 60 and walls 64, 66 which are in direct communication with a steam source. A steam tunnel such as a steam tunnel conditioning unit manufactured by COMAS may be used. The reorderer 34 is kept at an upward angle of about 2.5° and moves the tobacco bed, which is still at about 3 inches depth, down the bed 60 using vibrational conveyance. The plurality of atomizers 62 utilized in the steam tunnel 40 provide a fine mist of moisture in order to evenly raise the moisture level of the tobacco bed without great deviation in any sample area. Steam tunnel 40 is about 20 feet in length, 7 feet wide matching the width of dryer 38 and cooler 32. Tobacco 12 has a total residence time within the reorderer of only about 15 seconds. The moisture content of the tobacco 12 upon exiting reorderer 34 is uniformly 15% throughout.

The apparatus 10, dryer, cooler and reorderer, of the preferred embodiment of the present invention has a total length of about 120 feet and is 7 feet wide. The handling capacity of the method and apparatus of the present invention is approximately 14,000 pounds/hour at the exit of the reorderer. Total residence time of the tobacco in the dryer, cooler and reorderer is about 90 seconds. This is a marked improvement from prior art dryers and reorderers which have required a total residence time in the order of about 20 minutes and encompass more than 200 feet in length and have exit reordering capacities of about 10,000 pounds/hour.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A method for rapid drying, cooling and reordering of tobacco comprising:

loading said tobacco onto a continuous conveyor belt at a predetermined bed depth;

conveying said tobacco on said conveyor belt through a dryer using a fluidized bed of heated air;

conveying said tobacco on said conveyor belt through a dryer using a fluidized bed of ambient air;

transferring said tobacco to a steam tunnel having a vibrating conveyor;

reordering said tobacco in said steam tunnel;

wherein said conveying of said tobacco through said dryer further comprises:

directing air heated to a first preselected temperature in a first heating zone;

recirculating said air in said first heating zone;

directing air heated to a second preselected temperature in a plurality of downstream heating zones from said first heating zone;

recirculating said air in said plurality of downstream heating zones;

reducing the moisture content of said tobacco to around 5%; and, elevating the temperature of said tobacco to about 240° F.

2. The method of claim 1 wherein said predetermined bed depth of said tobacco is about three inches.

3. The method of claim 1 wherein said tobacco is conveyed through said dryer and said cooler at about 1.3 ft/sec.

4. The method of claim 1 wherein said first preselected temperature is about 220° F.

5. The method of claim 1 wherein said second preselected temperature is about 240° F.

6. The method of claim 1 wherein said air in said first heating zone and said plurality of downstream heating zones is contained in a closed system.

7. The method of claim 1 wherein said cooling of said tobacco further comprises:

directing ambient air at said tobacco;

recirculating said air within said cooler; and, reducing the temperature of said tobacco to about 80° F.

8. The method of claim 1 wherein said reordering of said tobacco further comprises:

conveying said tobacco through said steam tunnel using a vibrating conveyor;

injecting steam into said steam tunnel from a plurality of sources; and, raising the moisture content of said tobacco to about 15%.

9. An apparatus for rapid drying, cooling and reordering strip tobacco, comprising:

a tobacco dryer having a plurality of individually controlled heating zones, said dryer further comprising:

a first heating zone which subjects said tobacco to high pressure air heated to about 220° F.;

a second heating zone which subjects said tobacco to high pressure air heated to about 240° F.;

a third heating zone which subjects said tobacco to high pressure air heated to about 240° F.;

a fourth heating zone which subjects said tobacco to high pressure air heated to about 240° F.; and, a fifth heating zone which subjects said tobacco to high pressure air heated to about 240° F.;

a tobacco cooler having a cooling zone;

a continuous conveyor belt extending through said tobacco dryer and said tobacco cooler;

a steam bed transitioning area at the end of said continuous conveyor;

a reorderer having a steam tunnel formed therethrough; and, a vibrating conveyor adjoining said steam bed transitioning area and extending through said reorderer.

10. The apparatus of claim 9 wherein said vibrating conveyor forms a 2.50° upward sloping surface.

11. The apparatus of claim 9 wherein said dryer further comprises a fluidized bed.

12. The dryer of claim 9 wherein each of said heating zones includes means to recirculate said high pressure air.

13. The apparatus of claim 9 wherein said cooler further comprises a cooling zone which includes means to subject said tobacco to high pressure ambient air.

14. The apparatus of claim 9 wherein said continuous conveyor operates at about 1.5 ft/sec.

15. The apparatus of claim 9 wherein said reorderer further comprises:

a bottom conveying surface;

a first and second side wall; and, a plurality of atomizers in fluid communication with a steam source, said plurality of atomizers formed on said bottom conveying surface and said first and second side wall.

16. The apparatus of claim 9 wherein said vibrating conveyor moves said tobacco at about 1.5 ft/sec.

* * * * *